US010315061B2

(12) United States Patent
Yu

(10) Patent No.: US 10,315,061 B2
(45) Date of Patent: Jun. 11, 2019

(54) SKIPPING HEAD WITH SELF-LOCKING SKIPPING ROPE

(71) Applicant: Xunqing Yu, Jiangxi (CN)

(72) Inventor: Xunqing Yu, Jiangxi (CN)

(73) Assignee: Yiwu Mida Hardware Co., Ltd., Yiwu, Zhejiang (CN)

( * ) Notice: Subject to any disclaimer, the term of this patent is extended or adjusted under 35 U.S.C. 154(b) by 0 days.

(21) Appl. No.: 15/786,605

(22) Filed: Oct. 18, 2017

(65) Prior Publication Data

US 2019/0111294 A1 Apr. 18, 2019

(51) Int. Cl.
*A63B 5/20* (2006.01)
*A63B 21/00* (2006.01)

(52) U.S. Cl.
CPC ..... *A63B 5/20* (2013.01); *A63B 5/205* (2013.01); *A63B 21/4033* (2015.10); *A63B 21/4035* (2015.10)

(58) Field of Classification Search
CPC ..... A63B 5/20; A63B 5/205; A63B 21/4035
See application file for complete search history.

(56) References Cited

U.S. PATENT DOCUMENTS 4,101,123 A * 7/1978 Anthony ..... A63B 5/20 482/82
4,801,137 A * 1/1989 Douglass ..... A63B 5/20 482/108
2013/0165299 A1* 6/2013 Hunt ..... A63B 5/20 482/82
2014/0221170 A1* 8/2014 Lin ..... A63B 5/20 482/82

* cited by examiner

*Primary Examiner* — Joshua Lee

(57) ABSTRACT

The disclosure discloses a skipping head with skipping rope self-locking function. The skipping head comprises a rope guide tube, a conical housing, steel balls, a spring, a compression nut, a bearing, a bearing seat and a screw; the rope guide tube is provided with three concentric circular holes, which are embedded with steel balls, to compose a skipping rope chuck; the tail end of the chuck is connected to a spring, which is connected with the conical housing through the compression nut, to compose a skipping rope self-locking device; a bearing is internally installed at both ends of the bearing seat respectively, to form a skipping head rotating device; one end of the bearing seat is connected with a rope locking device, the other end will be connected with a skipping handle; the rotating device and the skipping rope gripping device are integrally connected by the screw.

1 Claim, 3 Drawing Sheets

SKIPPING HEAD WITH SELF-LOCKING SKIPPING ROPE

BACKGROUND OF THE INVENTION

1. Field of the Invention

The disclosure belongs to the technical field of skipping rope locking, and in particular relates to a skipping head with skipping rope self-locking function.

2. Description of the Related Art

At present, there are several ways to lock rope: 1. knotting fixation; 2. external screw compression; 3. Winding. Whichever method is used, the disassembly and assembly are cumbersome, and inconvenient for people to use. The rope is easily loose in the course of movement, resulting in the falling off phenomenon of the skipping rope.

The information disclosed in this Background of the disclosure is only for enhancement of understanding of the general background of the disclosure and should not be taken as an acknowledgment or any form of suggestion that this information forms the prior art already known to a person skilled in the art.

SUMMARY OF THE INVENTION

An object of the disclosure is to provide a skipping head with skipping rope self-locking function, thereby overcoming the above-mentioned deficiencies in the prior art.

In order to achieve the above object, the disclosure provides a skipping head with self-locking skipping rope; the skipping head comprises a rope guide tube, a conical housing, steel balls, a spring, a compression nut, a bearing, a bearing seat and a screw; the portion close to the tail part of the rope guide tube is provided with three concentric circular holes, which are embedded with steel balls; the tail end is connected with the spring; the spring, rope guide tube and three steel balls are assembled in the conical housing through the compression nut, to compose a rope locking device. A bearing is internally installed at both ends of the bearing seat, to compose a skipping rope 360-degree rotating device; the other end of the rotating device is provided with external thread, which will be connected with a skipping handle; the rope locking device and the rotating device are connected by the screw, to compose a skipping head with skipping rope self-locking function. The external thread at one end of the skipping head can be connected with a variety of skipping handles; the variety of skipping handles are connected with the skipping head, to create more colorful skipping ropes.

The skipping rope is inserted into the skipping head; the steel balls are squeezed inwards under the action force between the spring and inner wall of the conical housing; in the rope skipping, the skipping rope drives the bearing of the bearing seat to perform a 360-degree rotation, press the rope guide tube, to release the action force between the spring and inner wall of the conical housing for squeezing the steel balls, so that the skipping rope is easily removed.

Compared with the prior art, the disclosure has the following beneficial effects:

The skipping head is simple in structure, can be connected with a variety of skipping handles; the skipping rope can be quickly assembled and disassembled; it replaces the original rope locking methods such as knotting fixation, setting external screws and winding; therefore, it is convenient to operate. In the rope skipping, the skipping rope is clamped by the skipping metal head, and continuously rotated in 360 degrees along with the skipping head with double bearings. The skipping head has different roles; the arbitrary elongation and shortening of the line length play a regulating role.

Figure 1:
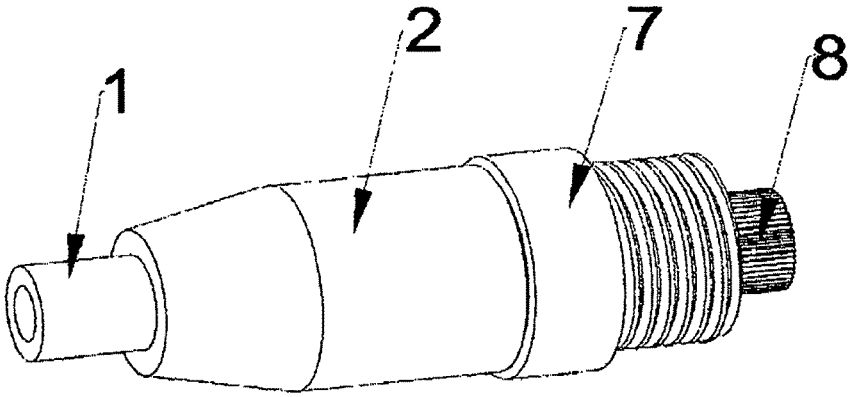
FIG. 1 is an assembly diagram of the skipping head with self-locking skipping rope according to the disclosure.

Reference numerals: 1—rope guide tube, 2—conical housing; 3—steel ball, 4—spring, 5—compression nut, 6—bearing, 7—bearing seat, 8—screw.

DETAILED DESCRIPTION OF THE PREFERRED EMBODIMENTS

The specific embodiments of the disclosure will be described in detail below, but it is understood that the scope of the disclosure is not limited to the specific embodiments.

Unless otherwise explicitly indicated, in the entire specification and claims, the term "comprise" or the transformed forms such as "comprising" or "comprises" will be understood to include the stated elements or components, but other components or other components are not excluded.

Figure 2:
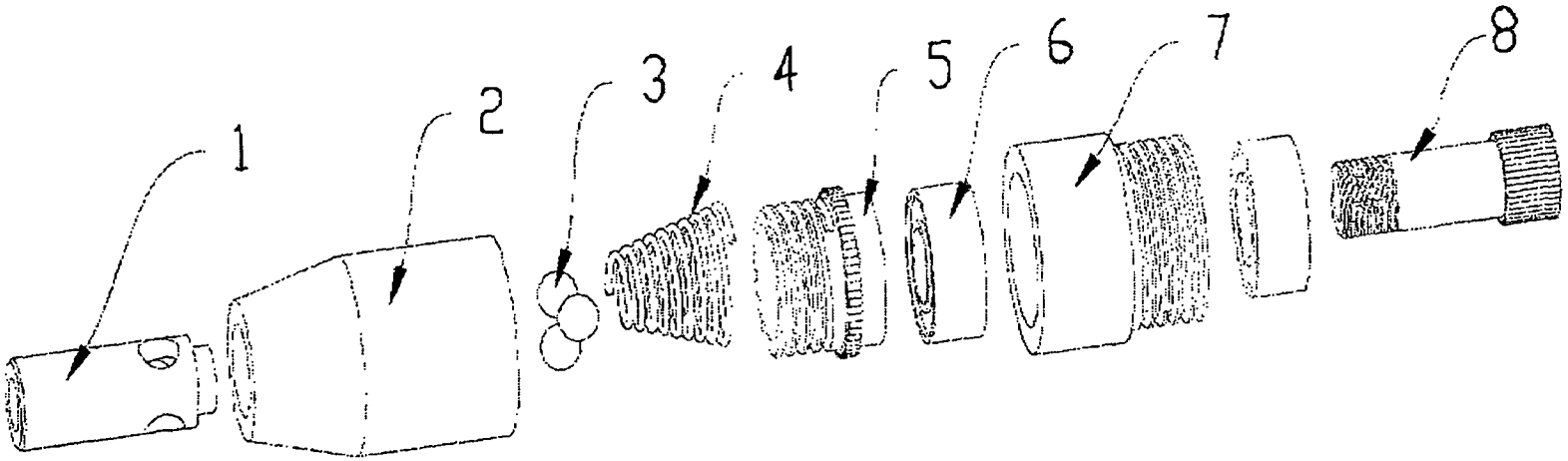
FIG. 2 is an exploded view of the skipping head with self-locking skipping rope according to the disclosure.

As shown in FIGS. 1-2, a skipping head with self-locking skipping rope, comprising: rope guide tube 1, conical housing 2, steel ball 3, spring 4, compression nut 5, bearing 6, bearing seat 7 and screw 8.

Figure 3:
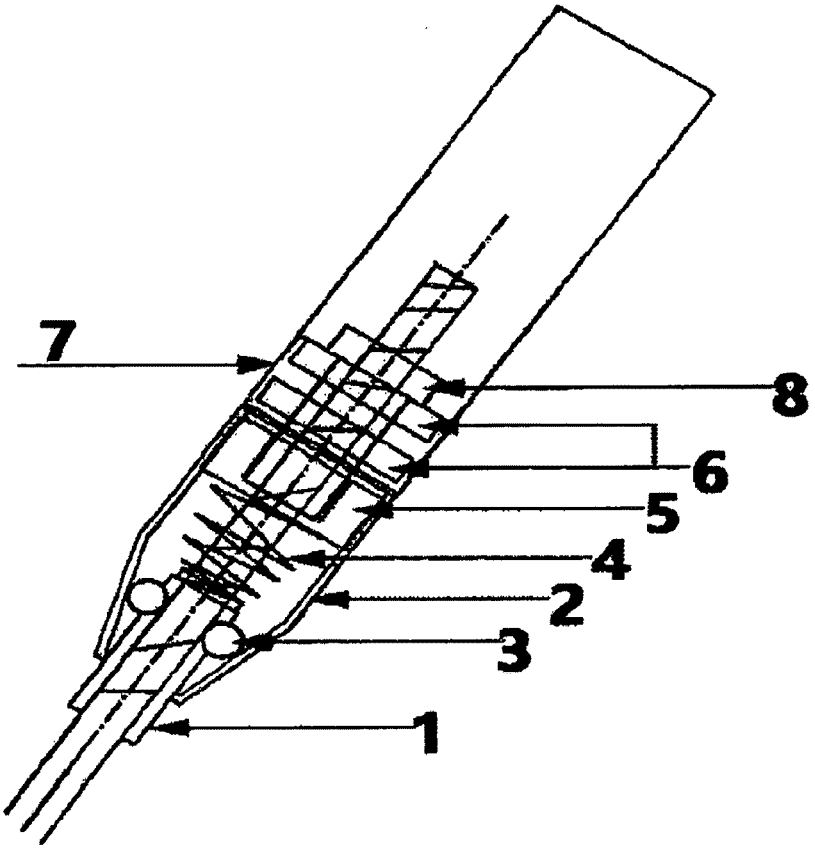
FIG. 3 is an assembly diagram of the skipping head with self-locking skipping rope according to the disclosure.

As shown in FIG. 3, the steel ball 3 is embedded in the rope guide tube 1 and assembled in the conical housing 2; the spring 4 tightly presses the tail end of the guide rope tube; the spring 4, rope guide tube 1 and steel ball 3 are compressed by the compression nut 5 and assembled in the conical housing 2, to compose a rope locking device. The bearing 6 is assembled in the bearing seat 7, to compose a rotating device. The rope locking device is connected with the rotating device by the screw, to compose a skipping head with skipping rope self-locking function; the external thread at the other end of the baring seat of the skipping head can be connected with a variety of skipping handles, to create colorful and various styles of skipping ropes.

The foregoing specific exemplary embodiments of the disclosure are described for description and illustration. These descriptions are not intended to limit the disclosure to the precise form disclosed; and it is obvious that many changes and modifications may be made in light of the above teachings. The purpose of selecting and describing the exemplary embodiments is to explain the specific principles of the disclosure and their practical application, so that those skilled in the art will be able to realize and utilize various exemplary embodiments of the disclosure as well as different choice and changes. The scope of the disclosure is intended to be limited by the claims and their equivalents.

What is claimed is:

1. A skipping head with a skipping rope locking function, comprising a rope guide tube, a conical housing, three steel balls, a spring, a compression nut, a bearing, a bearing seat and a screw; a tail part of the rope guide tube is provided with three circular holes, which are embedded with the three steel balls; a tail end is connected with the spring; the spring, the rope guide tube and the three steel balls are assembled in the conical housing through the compression nut, to form a rope locking device; a bearing is internally installed at both ends of the bearing seat, to form a skipping rope 360-degree rotating device; one end of the bearing seat is provided with external threads adapted for connection to a skipping handle; the rope locking device and the rotating device are connected to each ether by the screw.

* * * * *